US006176410B1

(12) United States Patent
Ueda et al.

(10) Patent No.: US 6,176,410 B1
(45) Date of Patent: Jan. 23, 2001

(54) METHOD AND APPARATUS FOR CONTROLLING WEB DELIVERY RUNNING AT THE START TIME OF PRINTING

(75) Inventors: Yoshio Ueda; Hitoshi Hirose, both of Mihara; Norifumi Tasaka; Masakazu Akatsuka, both of Hiroshima, all of (JP)

(73) Assignee: Mitsubishi Heavy Industries, Ltd., Tokyo (JP)

( * ) Notice: Under 35 U.S.C. 154(b), the term of this patent shall be extended for 0 days.

(21) Appl. No.: 09/294,622

(22) Filed: Apr. 19, 1999

(51) Int. Cl.[7] ..... B65H 23/18

(52) U.S. Cl. ..... 226/4; 226/8; 226/24; 226/111; 101/228

(58) Field of Search ..... 242/413.3; 226/27, 226/111, 4, 29, 112, 118.1, 91, 8, 24; 101/DIG. 42, 228

(56) References Cited

U.S. PATENT DOCUMENTS

| | | | | |
|---|---|---|---|---|
| 3,561,654 | * | 2/1971 | Greiner | 226/111 X |
| 4,391,190 | * | 7/1983 | Metzler | 226/27 X |
| 4,633,694 | * | 1/1987 | Miyazaki | 72/10.3 |
| 4,704,171 | * | 11/1987 | Thompson et al. | 226/29 X |
| 4,729,520 | * | 3/1988 | Kataoka | 242/412.2 |
| 4,751,879 | * | 6/1988 | Pelt | 101/228 |
| 4,781,317 | * | 11/1988 | Ditto | 226/29 X |
| 4,848,630 | * | 7/1989 | Niestrath et al. | 226/4 |
| 4,896,808 | * | 1/1990 | Schaede | 226/42 |
| 4,898,094 | * | 2/1990 | Doumoto et al. | 226/4 X |
| 4,984,458 | * | 1/1991 | Montgomery et al. | 226/27 X |
| 5,365,844 | * | 11/1994 | Miyashige . | |
| 5,386,772 | * | 2/1995 | Tolle et al. . | |
| 5,505,550 | * | 4/1996 | Kitahara et al. | 226/29 X |
| 5,524,805 | * | 6/1996 | Shiba et al. | 226/108 |
| 5,542,350 | * | 8/1996 | Theilacker et al. | 226/4 X |
| 5,751,331 | * | 5/1998 | Higuchi et al. | 347/217 |
| 5,765,481 | | 6/1998 | Tortora et al. . | |
| 5,768,959 | * | 6/1998 | Lorenzo | 83/74 |
| 5,791,541 | * | 8/1998 | Jitsuishi et al. . | |
| 5,865,118 | | 2/1999 | Fromson et al. . | |
| 5,903,794 | * | 5/1999 | Sheley et al. | 396/612 |

FOREIGN PATENT DOCUMENTS

| | | | |
|---|---|---|---|
| 2236983 | * | 4/1991 | (GB) . |
| WO 94/29113 | | 12/1994 | (WO) . |

* cited by examiner

*Primary Examiner*—Donald P. Walsh
*Assistant Examiner*—Collin A. Webb
(74) *Attorney, Agent, or Firm*—Alston & Bird LLP

(57) ABSTRACT

Drag rollers disposed in a region from the paper feed side to the paper discharge side of a printing machine are driven one after another from the paper feed side with torque control, by which the slack of a web is removed successively from the upstream side of a web delivery running path. Also, a plurality of tension sensors for detecting a tension of a web between a feeder and a feed drag roller and between drag rollers disposed in a region from the paper feed side to the paper discharge side of a printing machine are provided, and a controller to which a tension detection signal from the plurality of tension sensors is supplied as a control signal is provided, by which slack of the web is removed and a predetermined preliminary tension is given to the web successively from the upstream side of a web running path by driving each drag roller with torque control based on the control signal from the controller at the start time of printing, and thereafter the driving of the drag roller at a location where the slack of the web has been removed is switched to speed control successively.

9 Claims, 6 Drawing Sheets

METHOD AND APPARATUS FOR CONTROLLING WEB DELIVERY RUNNING AT THE START TIME OF PRINTING

FIELD OF THE INVENTION AND RELATED ART STATEMENT

The present invention relates to a method and an apparatus for controlling web delivery running in a printing machine (electronic printing machine etc.).

FIG. 6 is a schematic view showing the whole of an electronic printing machine used for printing one side and both sides of paper. For this electronic printing machine, as shown in FIG. 6, a web 14 supplied by a roll 20 set on a feeder 1 is drawn by a feed drag roller 7 and is supplied to a printing unit 2. Subsequently, the web 14 is put into print (toner is made to adhere), and toner is fixed to the web 14 by a first fixing roller 3 and a second fixing roller 4. Thus, after passing through the second fixing roller 4, the web 14 is discharged by a discharge drag roller 13, and is cut and arranged properly by a cutter 6, thereby completing printed matters. In FIG. 6, reference numerals 9*a*, 9*b* and 9*c* denote paper pressing rollers, 10*a*, 10*b* and 10*c* denote servomotors, and 11 denotes a web brake.

When only one side of the web 14 is printed by the aforementioned electronic printing machine (in the case of one-side printing), after the web 14 passes through the feed drag roller 7, one side of the web 14 is printed by printing units 2*a* and 2*b*, and toner is fixed by the first fixing roller 3. Then, the web 14 is introduced to an intermediate drag roller 8. Further, after one side of the web 14 is printed by printing units 2*c* and 2*d* and is fixed by the second fixing roller 4, the web 14, being sent to the cutter 6 by the discharge drag roller 13, is cut and arranged properly, thereby completing printed matters.

When both sides of the web 14 is printed by the aforementioned electronic printing machine (in the case of two-side printing), after the top surface (one side) of the web 14 is printed by the printing units 2*a* and 2*b* and is fixed by the first fixing roller 3, the web 14 is turned over by an inversion turn bar 5 and sent to the printing units 2*c* and 2*d* by the intermediate drag roller 8, by which the back surface is printed. Next, after being fixed by the second fixing roller 4, the web 14 is cut and arranged properly by the cutter 6 as in the case of one-side printing, thereby completing two-side printed matters.

In the conventional electronic printing machine, the web 14 is heated when passing through the first fixing roller 3, so that the length of paper is changed. Therefore, in multi-color printing by process color, in which overprinting must be performed by the printing units 2*c* and 2*d* successively, there arises a problem in that the print registering (printing registration) goes wrong, and accurate multi-color printing cannot be performed. For this reason, conventionally in the actual situation, a configuration is used such that the intermediate drag roller 8 is disposed between the feed drag roller 7 and the discharge drag roller 13 to control tensions between the feed drag roller 7 and the intermediate drag roller 8 and between the intermediate drag roller 8 and the discharge drag roller 13, by which the elongation of the web 14 passing through the printing units 2*a* and 2*b* and the elongation of the web 14 passing through the printing units 2*c* and 2*d* are made equal to each other, whereby the accuracy of print registering (printing registration) is improved.

Next, a mechanism of generating a tension between the drag rollers will be described below with reference to the figure. The book titled "Offset Printing Machines" published by Japan Printing News Co., Ltd. describes that generally, an inlet tension of printing section, that is, a tension in a region ranging from the feeder 1 to the feed drag roller 7 is a base tension for paper tension at all paper paths of the printing machine downstream of the feed drag roller 7, and is a dominant factor contributing to the stabilization of printing accuracy etc. Also, the aforementioned book gives an equation for infeed tension. If in this equation, the metering roller is replaced with the feed drag roller and the printing unit peripheral velocity is replaced with the intermediate drag roller peripheral velocity, the following equation can be obtained.

$$F_z \approx \frac{1}{\left(1+\frac{E}{\eta}T_z\right)}\left\{a\cdot 1\cdot E\frac{V_0-V_1}{V_0}+F_1\right\} \tag{1}$$

where, $F_2$ is infeed tension, $F_1$ is feed drag roller inlet tension, $V_0$ is intermediate drag roller peripheral velocity, $V_1$ is feed drag roller peripheral velocity, E is Young's modulus of paper, $\eta$ is coefficient of viscosity of paper, a is paper thickness, l is paper width, and $T_2$ is time constant (time taken for paper to pass through a span from the feed drag roller to the intermediate drag roller).

A tension between the intermediate drag roller 8 and the discharge drag roller 13 can also be determined if in Equation (1), the intermediate drag roller peripheral velocity is replaced with the discharge drag roller peripheral velocity, the feed drag roller peripheral velocity is replaced with the intermediate drag roller peripheral velocity, and the feed drag roller inlet tension $F_1$ is replaced with the infeed tension $F_2$ determined by Equation (1).

Thereupon, for example, even if the tension $F_1$ of the feeder 1 is kept constant, when the peripheral velocity $V_1$ of the feed drag roller 7 or the peripheral velocity $V_0$ of the intermediate drag roller 8 is changed, the infeed tension $F_2$, that is, the paper tension between the feed drag roller 7 and the intermediate drag roller 8 changes. This also holds true for the paper tension between the intermediate drag roller 8 and the discharge drag roller 13. In this tension control, it is unpreferable to carry out torque control for keeping the torque of motor for driving the drag roller because the torque control causes a fluctuation in drag roller peripheral velocity. Conventionally, therefore, the speed has been controlled for the drive of the drag roller.

However, when such speed control is carried out, a problem described below arises. In the conventional speed control, in the case where slack is produced in the web 14 after it passes through the drag rollers 7, 8 or 13, if the peripheral velocity difference between the drag rollers is small, it takes considerable time before the slack is removed and the tension is stabilized, so that much spoilage (paper loss) occurs before printed matters with accurate print registering (printing registration) in the running direction of the web 14 can be obtained.

OBJECT AND SUMMARY OF THE INVENTION

The present invention has been made to solve the above problem, and an object thereof is to provide a method and an apparatus for controlling web delivery running at the start time of printing, in which the slack of a web (paper) can be removed in a short period of time, the time taken for a tension to be stabilized after the start of printing (after the start of operation) can be shortened greatly, and the occurrence of spoilage caused by inaccurate print registering (deviation of registering) in the web running direction can be reduced significantly.

To achieve the above object, in the method for controlling web delivery running at the start time of printing in accordance with the present invention, drag rollers disposed in a region from the paper feed side to the paper discharge side of a printing machine are driven one after another from the paper feed side with torque control, by which the slack of a web is removed successively from the upstream side of a web delivery running path.

Also, in the method for controlling web delivery running at the start time of printing in accordance with the present invention, by giving a preliminary tension to between the drag rollers, the time from when the torque control state in which the drag roller is driven with torque control is switched to the speed control state in which the drag roller is driven with speed control to when the tension of web between the drag rollers is stabilized is shortened.

Also, in the method for controlling web delivery running at the start time of printing in accordance with the present invention, the tension of the web between a feeder and a feed drag roller and between the drag rollers is detected by a tension sensor, and the tension control of the web is carried out based on the tension detection value detected by the tension sensor.

Also, in the method for controlling web delivery running at the start time of printing in accordance with the present invention, (a) a slack removing step of removing the slack of a web successively from the upstream side of a web delivery running path by driving drag rollers, which are disposed in a region from the paper feed side to the paper discharge side of a printing machine, successively from the paper feed side;

(b) a drag roller stopping step of stopping the driving of a drag roller on the upstream side when the slack of the web on the upstream side is removed in the slack removing step; and (c) a driving state switching step of switching the driving of drag roller, the driving of which is stopped in the drag roller stopping step, to speed control are executed successively.

Also, in the apparatus for controlling web delivery running at the start time of printing in accordance with the present invention, a plurality of tension sensors for detecting a tension of a web between a feeder and a feed drag roller and between drag rollers disposed in a region from the paper feed side to the paper discharge side of a printing machine are provided, and a controller to which a tension detection signal from the plurality of tension sensors is supplied as a control signal is provided, by which slack of the web is removed and a predetermined preliminary tension is given to the web successively from the upstream side of a web running path by driving each drag roller with torque control based on the control signal from the controller at the start time of printing, and thereafter the driving of the drag roller at a location where the slack of the web has been removed is switched to speed control successively.

BRIEF DESCRIPTION OF THE DRAWINGS

FIG. 2 is a schematic view for illustrating a method for controlling web delivery running in accordance with the present invention, in which

DETAILED DESCRIPTION OF PREFERRED EMBODIMENTS

Figure 1:
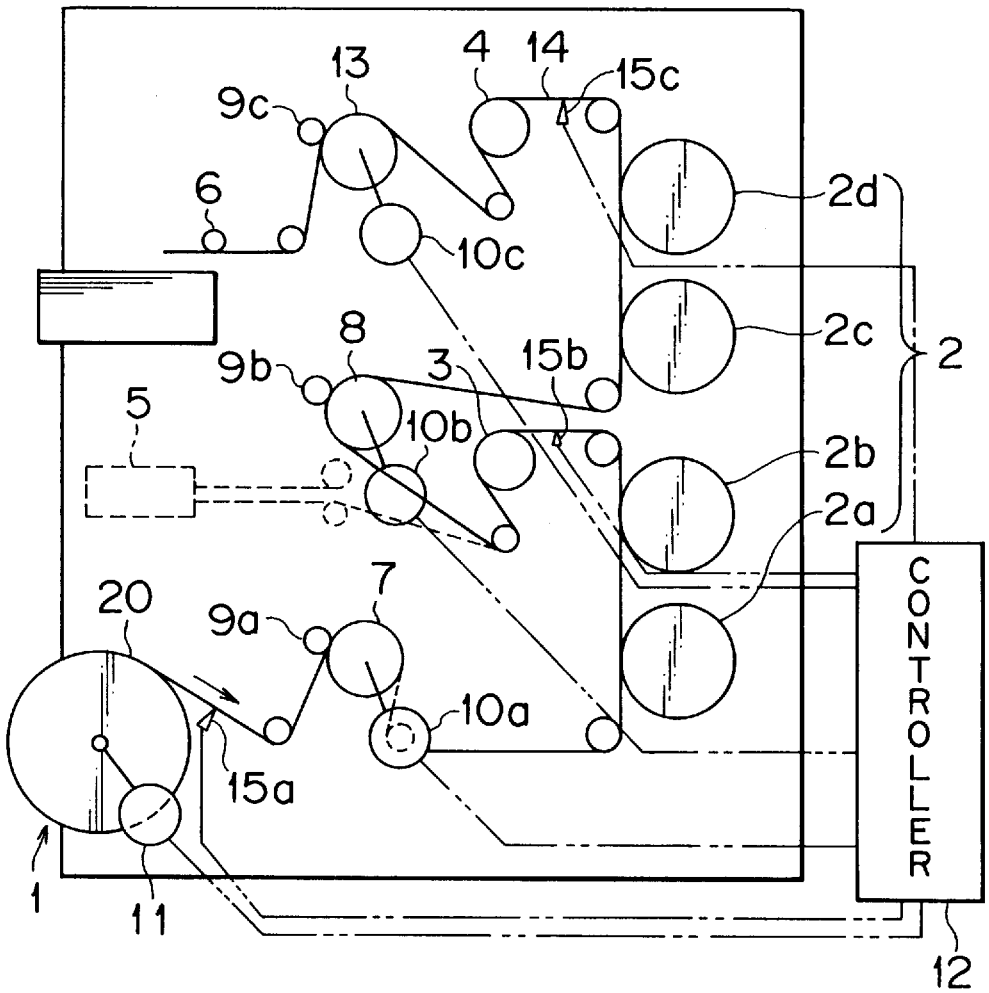
FIG. 1 is a system configuration view of an electronic printing machine equipped with an apparatus for controlling web delivery running in accordance with one embodiment of the present invention.
Figure 2A:
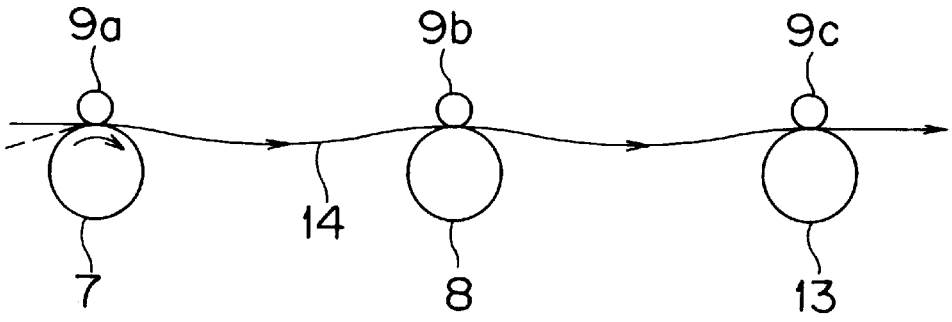
FIG. 2A is a schematic view showing a state in which slack of paper (web) is present between a feed drag roller and an intermediate drag roller and between the intermediate drag roller and a discharge drag roller.

An embodiment of the present invention will be described below with reference to FIGS. 1 to 5. In FIGS. 1 and 2, the same reference numerals are applied to elements which are essentially the same as the elements shown in FIG. 6, and the duplicated description of these elements is omitted.

FIG. 1 shows a configuration of an electronic printing machine equipped with an apparatus for controlling web delivery running in accordance with one embodiment of the present invention. As shown in FIG. 1, the whole configuration of this electronic printing machine is the same as that of a conventional electronic printing machine. In this embodiment, however, the roller driving servomotors 10*a*, 10*b* and 10*c* installed to the drag rollers 7, 8 and 13, respectively, are configured so as to be capable of performing both of speed control and torque control, and the controller 12 has a function of performing the switching between speed control and torque control and the control. Further, as shown in FIG. 1, tension sensors 15*a*, 15*b* and 15*c* for detecting a tension of the web 14 are provided between the feeder 1 and the feed drag roller 7, between the feed drag roller 7 and the intermediate drag roller 8, and between the intermediate drag roller 8 and the discharge drag roller 13, respectively, and the outputs of these tension sensors 15*a*, 15*b* and 15*c* are sent to the controller 12 as a control signal.

The following is a description of an operation for removing the slack of the web 14 in the electronic printing machine of this embodiment. First, as indicated by an arrow in FIG. 2A, the slack of the web 14 between the feeder 1 and the feed drag roller 7 is removed by driving only the feed drag roller 7 with torque control. The removed slack of the web 14 is accumulated between the feed drag roller 7 and the intermediate drag roller 8. When the slack of the web 14 between the feeder 1 and the feed drag roller 7 is removed, the feed drag roller 7 is subjected to a tension exceeding a torque control setting value, so that the peripheral velocity of the drag roller 7 becomes zero. At this point of time, the driving of the feed drag roller 7 is switched to speed control with the speed setting value being zero.

Figure 2B:
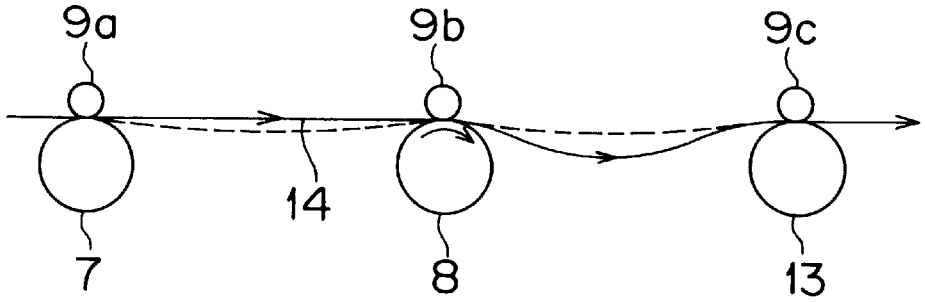
FIG. 2B is a schematic view showing a state in which slack of paper between the feed drag roller and the intermediate drag roller is removed and slack of paper is present between the intermediate drag roller and the discharge drag roller.

Next, in order to remove the slack of the web 14 accumulated between the feed drag roller 7 and the intermediate drag roller 8 (see FIG. 2A), as indicated by an arrow in FIG. 2B, only the intermediate drag roller 8 is driven with torque control to remove the slack of the web 14 accumulated between the feed drag roller 7 and the intermediate drag roller 8. When the slack of the web 14 between the feed drag roller 7 and the intermediate drag roller 8 is removed in this manner, the intermediate drag roller 8 is subjected to a tension exceeding a torque control setting value, so that the peripheral velocity of the drag roller 8 becomes zero. At this point of time, the driving of the feed drag roller 8 is switched to speed control with the speed setting value being zero.

Figure 2C:
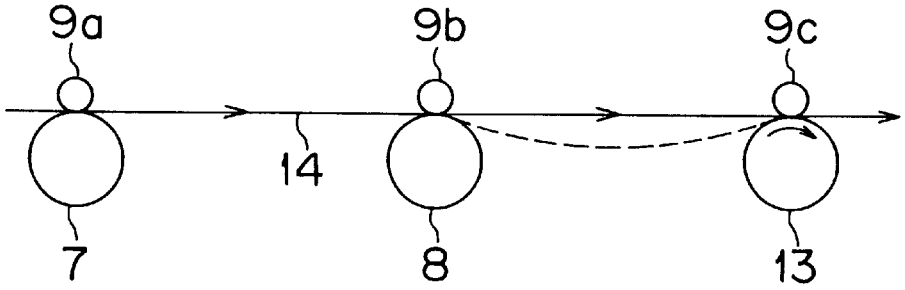
FIG. 2C is a schematic view showing a state in which slack of paper between the feed drag roller and the intermediate drag roller and between the intermediate drag roller and the discharge drag roller is removed.

Subsequently, by the same procedure as described above, only the discharge drag roller 13 is driven with torque control to remove the slack of the web 14 between the intermediate drag roller 8 and the discharge drag roller 13 (see FIG. 2C). At this point of time, the servomotors 10*a*, 10*b* and 10*c* for driving all of the drag rollers 7, 8 and 13 are switched to speed control with the speed setting value being zero.

At the time when all of the drag rollers 7, 8 and 13 are switched to speed control, the peripheral velocity of each drag roller for obtaining a tension needed between the drag rollers is determined by Equation (1) stated in the description of the prior art. The determined value is set as the speed setting value for the peripheral velocity of each drag roller, and all of the drag rollers 7, 8 and 13 are driven with speed control based on the speed setting value.

Figure 3:
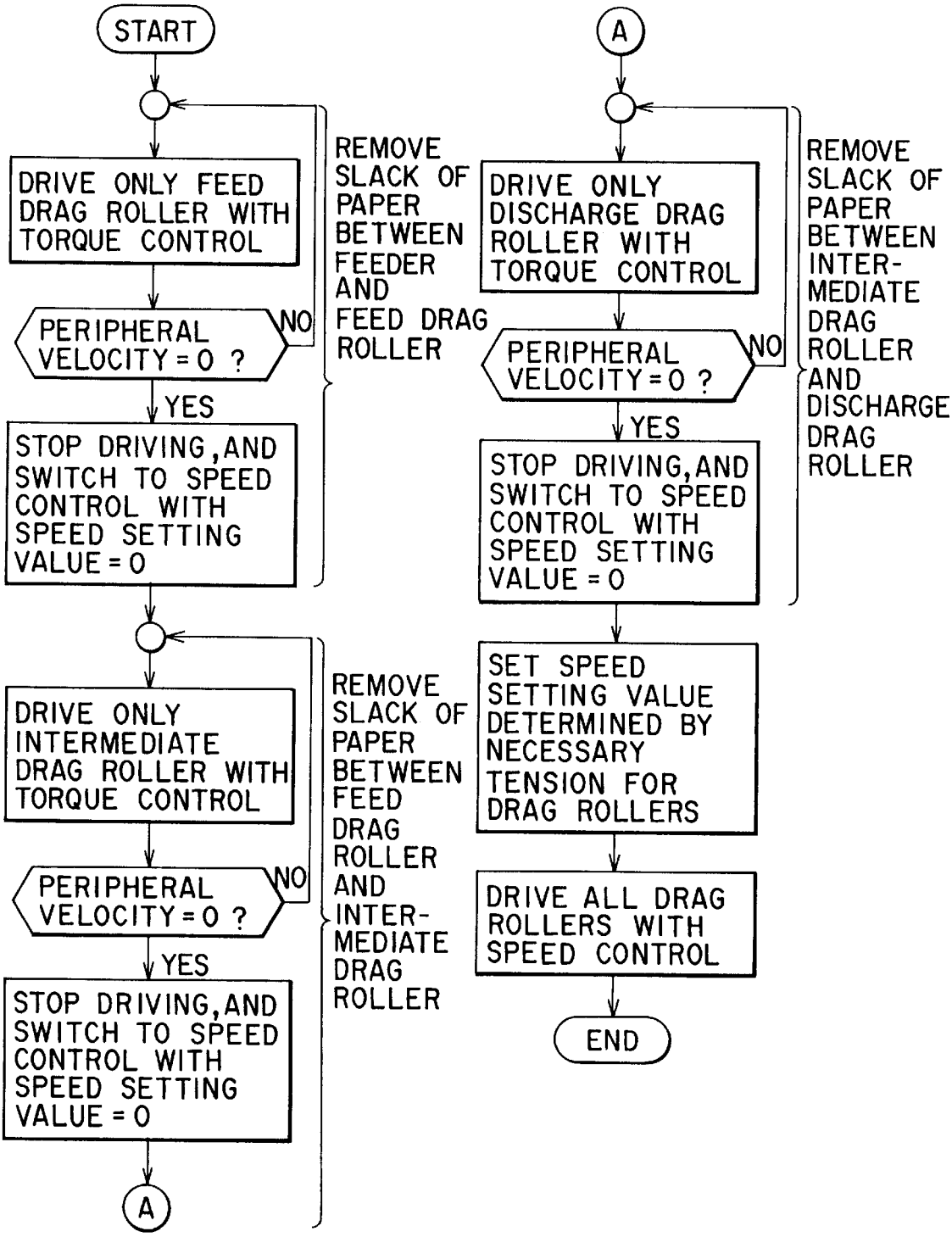
FIG. 3 is a flowchart showing one example of algorithm for the control of web delivery running when all drag rollers are driven with speed control.

A specific flowchart for the aforementioned control is shown in FIG. 3. In this case, only the feed drag roller 7 is first driven with torque control. When the peripheral velocity of the feed drag roller 7 becomes zero, the driving thereof is stopped, and the driving of the feed drag roller 7 is switched to speed control with the speed setting value being zero. Then only the intermediate drag roller 8 is driven with torque control. When the peripheral velocity of the intermediate drag roller 8 becomes zero, the driving thereof is stopped, and the driving of the intermediate drag roller 8 is switched to speed control with the speed setting value being zero. Subsequently, for all of the drag rollers 7, 8 and 13, the speed setting value determined by the necessary tension is set, and the driving of all of the drag rollers 7, 8 and 13 is switched to speed control based on the speed setting value.

Even when torque setting means cannot be used, a value larger than the value obtained by dividing the maximum value of slack quantity of web (paper) by the drag roller peripheral velocity is taken as a timer value, and the slack can be removed by driving the drag rollers 7, 8 and 13 one after another starting from the feed drag roller 7 as described before for a fixed time determined by the timer value. In this case, although the setting accuracy of preliminary tension is slightly lower than that of the method using torque control as described above, because a preliminary tension is given to the web, the time from when all of the drag rollers begin to be driven with speed control to when a steady tension can be obtained can be shortened.

Figure 4:
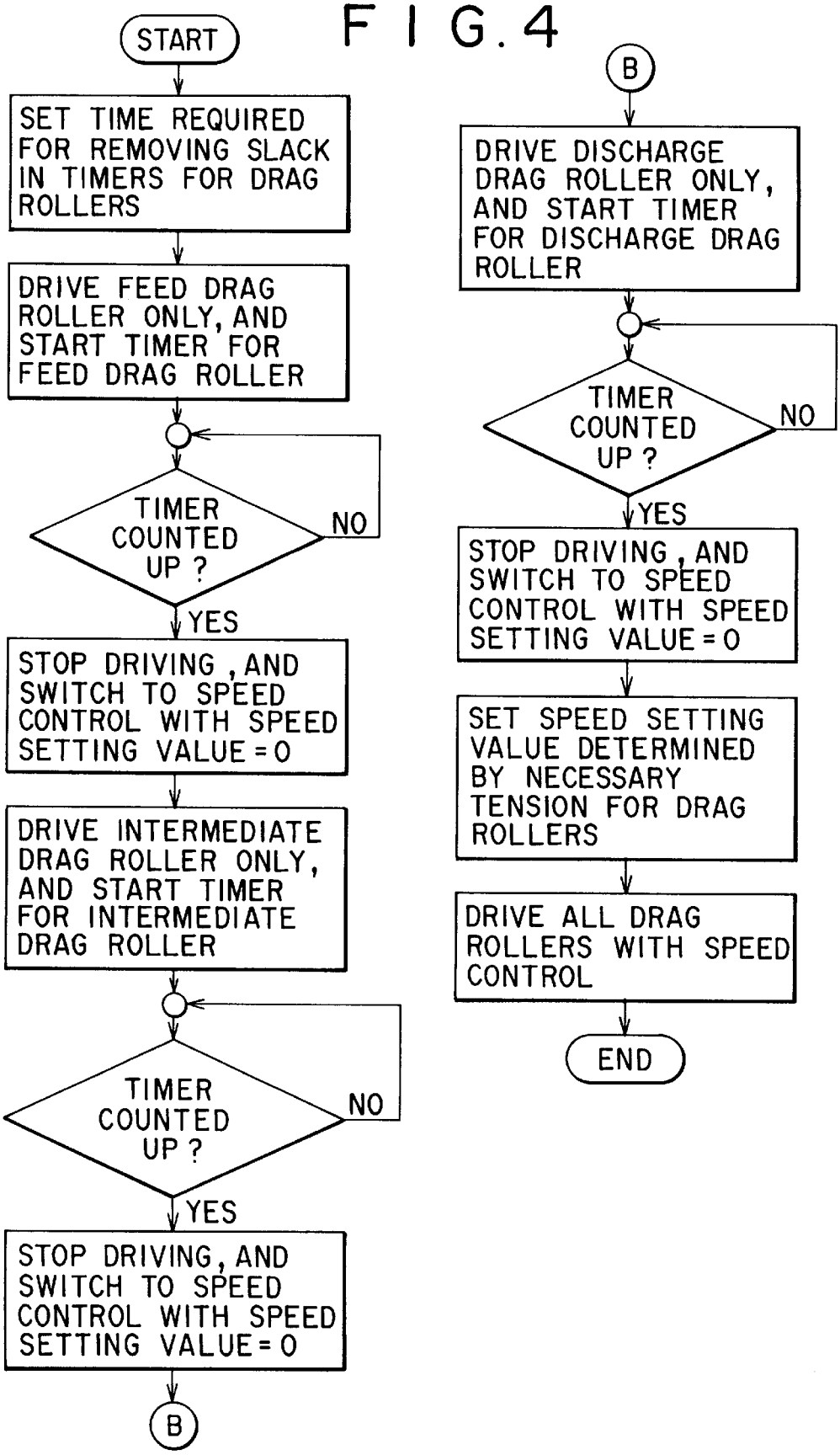
FIG. 4 is a flowchart showing one example of algorithm for the control of web delivery running when a timer is used in place of torque setting means.

FIG. 4 is a flowchart for specific control using a timer. In this case, the time required for removing the slack of the web 14 is set in advance in timers for the drag rollers 7, 8 and 13. First, only the feed drag roller 7 is driven, and the operation of the timer for the feed drag roller 7 is started. When the timer for the feed drag roller 7 is counted up, the driving of the feed drag roller 7 is stopped, and is switched to speed control under the condition of speed setting value=0. Then, only the intermediate drag roller 8 is driven, and the operation of the timer for the intermediate drag roller 8 is started. When the timer for the intermediate drag roller 8 is counted up, the driving of the intermediate drag roller 8 is stopped, and is switched to speed control under the condition of speed setting value=0. Next, only the discharge drag roller 13 is driven, and the operation of the timer for the discharge drag roller 13 is started. When the timer for the discharge drag roller 13 is counted up, the driving of the discharge drag roller 13 is stopped, and is switched to speed control under the condition of speed setting value=0. Subsequently, for all of the drag rollers 7, 8 and 13, the speed setting value determined by the necessary tension is set, and the driving of all of the drag rollers 7, 8 and 13 is switched to speed control based on the speed setting value.

As described above, the drag rollers 7, 8 and 13 disposed in the region from the paper feed side to the paper discharge side are driven one after another from the paper feed side with torque control to remove the slack of the web 14 successively from the upstream side of the web delivery running path. Thereby, the slack of the web 14 can be removed in a shorter time than the conventional slack removing method in which the slack of web is removed by a small difference in drag roller peripheral velocity. Also, by giving the preliminary tension to the web 14, the speed of all of the drag rollers 7, 8 and 13 is controlled with the predetermined setting speed, and the time from the start of driving to the stabilization of tension can be shortened greatly. Also, by applying the preliminary tension in a static state, the preliminary tension between the drag rollers can be given accurately. Therefore, the time taken for the necessary tension between the drag rollers to be stabilized after the switching to speed control can be shortened.

The following is a description of the functions of the tension sensors 15*a*, 15*b* and 15*c* in the electronic printing machine of this embodiment. First, only the feed drag roller 7 is driven, by which the slack of the web 14 between the feeder 1 and the feed drag roller 7 is removed. With the removal of the slack of the web 14, a tension is given to the web 14. The tension detection value detected by the tension sensor 15*a* at this time is supplied to the controller 12. Thus, when the tension detection value supplied from the tension sensor 15*a* to the controller 12 reaches a tension necessary during the operation, the driving of the feed drag roller 7 is stopped based on the control signal generated by the controller 12, so that the speed setting value is set at zero and the driving of the feed drag roller 7 is switched to speed control. The slack removal and tension control of the web 14 between the feed drag roller 7 and the intermediate drag roller 8 and between the intermediate drag roller 8 and the discharge drag roller 13 are performed successively as in the aforementioned case of the slack removal and tension control of the web 14 between the feeder 1 and the feed drag roller 7.

When the slack of the web 14 at all locations along the web delivery running path is removed and the preliminary tension is given to the web 14, all of the drag rollers 7, 8 and 13 are controlled with speed control with the speed setting value being zero. Subsequently, the speed setting value determined by using Equation (1) described in the conventional method is set for the drag rollers. After the completion of setting, all of the drag rollers 7, 8 and 13 are started with speed control at the same time, by which printing operation is started.

Figure 5:
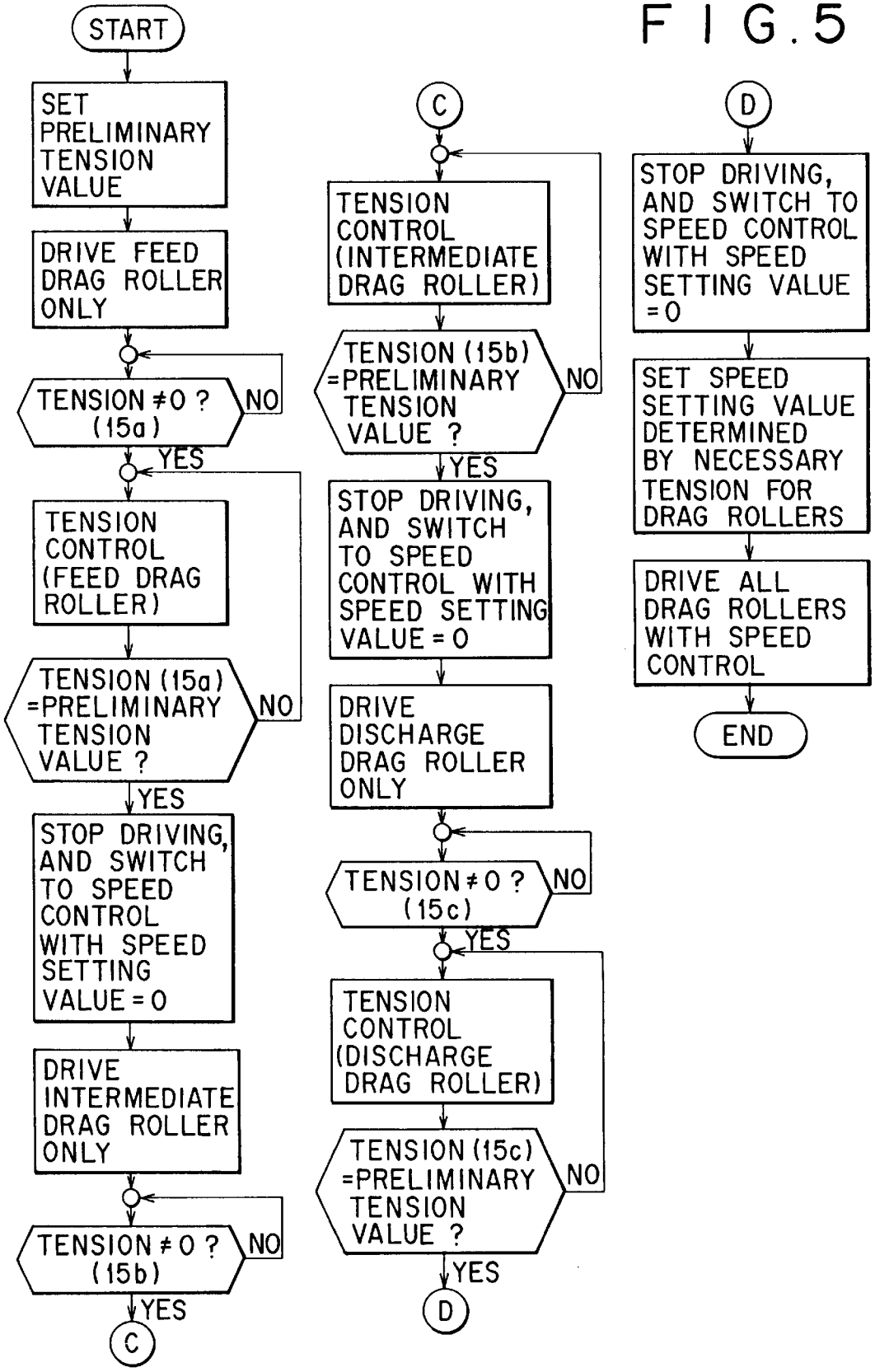
FIG. 5 is a flowchart showing one example of algorithm for the control of web delivery running when operation is started by starting all drag rollers with speed control at the same time.
Figure 6:
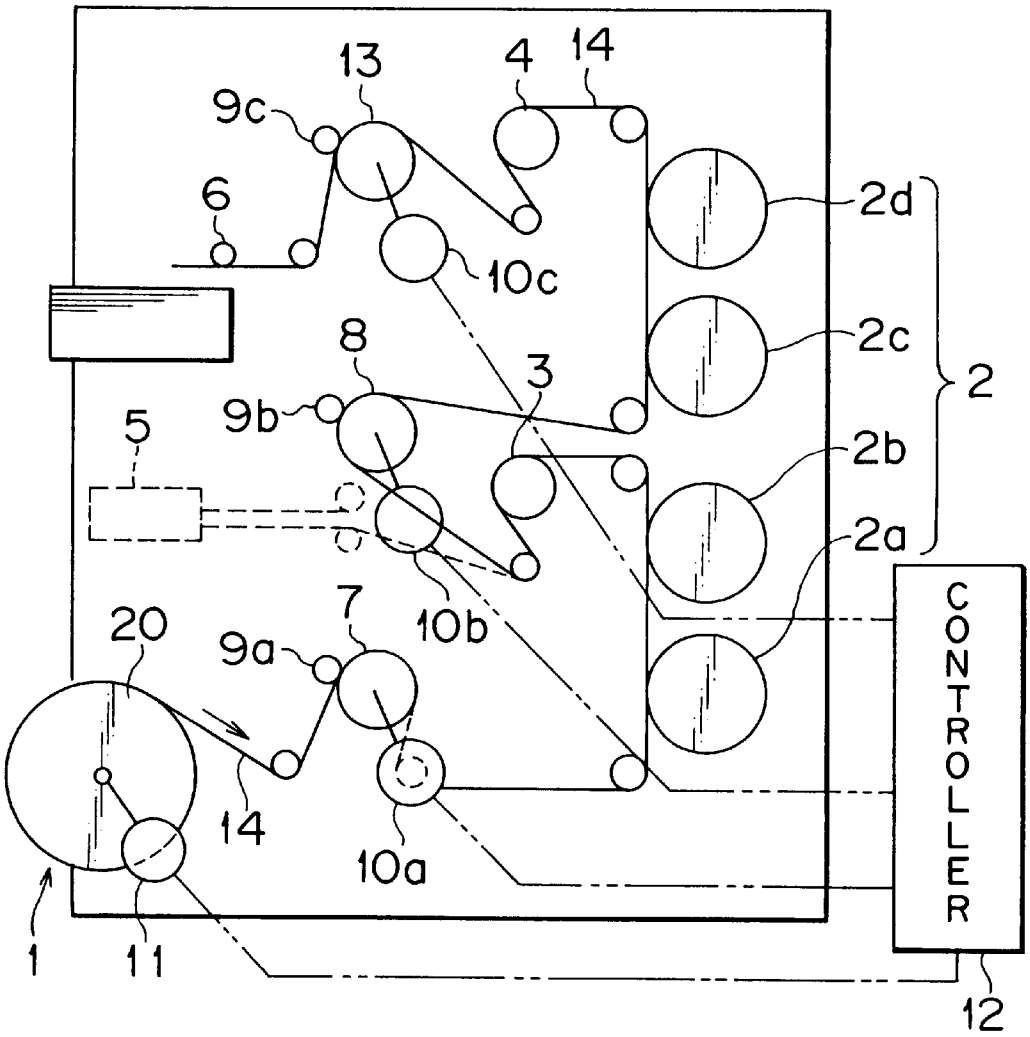
FIG.6 RELATED ART
FIG. 6 is a schematic view showing the whole configuration of a conventional electronic printing machine used for printing one side and both sides of paper.

FIG. 5 is a flowchart showing specific control in this case. In this case, a preliminary tension which should be given to the web 14 is set in advance. First, only the feed drag roller 7 is driven. From the time when the tension value detected by the tension sensor 15*a* becomes nonzero (when a tension is produced), the feed drag roller 7 is driven under tension control. When the preliminary tension of the web 14 between the feeder 1 and the feed drag roller 7 becomes the predetermined preliminary tension value set in advance, the driving of the feed drag roller 7 is stopped, and the driving is switched to speed control with the speed setting value being zero. Then, only the intermediate drag roller 8 is driven. From the time when the tension value detected by the tension sensor 15*b* becomes nonzero, the intermediate drag roller 8 is driven under tension control. When the preliminary tension of the web 14 on the upstream side of the first fixing roller 3 becomes the predetermined preliminary tension value set in advance, the driving of the intermediate drag roller 8 is stopped, and the driving is switched to speed control with the speed setting value being zero. Next, only the discharge drag roller 13 is driven. From the time when the tension value detected by the tension sensor 15*c* becomes nonzero, the discharge drag roller 13 is driven under tension control. When the preliminary tension of the web 14 on the upstream side of the second fixing roller 4 becomes the predetermined preliminary tension value set in advance, the driving of the discharge drag roller 13 is stopped, and the driving is switched to speed control with the speed setting value being zero. Subsequently, for all of the drag rollers 7, 8 and 13, the speed setting value determined by the necessary tension is set, and the driving of all of the drag rollers 7, 8 and 13 is switched to speed control based on the speed setting value.

According to this configuration, since the tension sensors 15*a*, 15*b* and 15*c* are disposed between the feeder 1 and the feed drag roller 7 and between the drag rollers 7, 8 and 13 to carry out tension control according to the detection value, the accuracy of preliminary tension at the start time of printing (start time of operation) is improved, and the time from when the operation is started by switching to speed control to when the tension is stabilized can be shortened greatly.

The above is a description of one embodiment of the present invention. The present invention is not limited to this embodiment, and various modifications and variations can be made based on the technical concept of the present invention. For example, although the case where the driving of three drag rollers 7, 8 and 13 is controlled has been described in the above embodiment, the present invention can be applied to a printing machine equipped with four or more drag rollers.

According to the present invention, drag rollers disposed in a region from the paper feed side to the paper discharge side of a printing machine are driven one after another from the paper feed side with torque control, by which the slack of a web is removed successively from the upstream side of a web delivery running path. Therefore, the slack of the web (paper) can be removed in a short period of time as compared with the conventional method in which the slack of the web is removed by a small difference in drag roller peripheral velocity. As a result, a trouble can be avoided such that much spoilage occurs before printed matters with high accuracy of printing registration in the web running direction are obtained.

According to the present invention, by giving a preliminary tension to between the drag rollers, the time from when the torque control state in which the drag roller is driven with torque control is switched to the speed control state in which the drag roller is driven with speed control to when the tension of web between the drag rollers is stabilized is shortened. Therefore, the quantity of spoilage caused by inaccurate print registering (deviation of registering) in the web running direction before the tension of the web is stabilized can be decreased. Also, since the preliminary tension is applied to between the drag rollers in a static state, the preliminary tension can be applied accurately, so that an effect can be achieved in shortening the time from when switching to speed control is performed to when the tension of web between the drag rollers is stabilized.

According to the present invention, the tension of the web between a feeder and a feed drag roller and between the drag rollers is detected by a tension sensor, and the tension control of the web is carried out based on the tension detection value detected by the tension sensor. Therefore, the setting accuracy of preliminary tension at the start time of printing (at the start time of operation of the printing machine) can be improved, and also the time from when printing is started by switching the driving to speed control to when the tension is stabilized can be shortened significantly. Thereby, the spoilage caused by inaccurate print registering (deviation of registering) in the web running direction before the tension is stabilized can be reduced significantly.

According to the present invention, a slack removing step of removing the slack of a web successively from the upstream side of a web delivery running path by driving drag rollers, which are disposed in a region from the paper feed side to the paper discharge side of a printing machine, successively from the paper feed side; a drag roller stopping step of stopping the driving of a drag roller on the upstream side when the slack of the web on the upstream side is removed in the slack removing step: and a driving state switching step of switching the driving of drag roller, the driving of which is stopped in the drag roller stopping step, to speed control are executed successively. Therefore, the slack of the web can be removed smoothly and rapidly, whereby spoilage can be reduced greatly, and also the preliminary tension can be applied to the web accurately, whereby the time before the tension between the drag rollers is stabilized can be shortened.

According to the present invention, a plurality of tension sensors for detecting a tension of a web between drag rollers disposed in a region from the paper feed side to the paper discharge side of a printing machine are provided, and a controller to which a tension detection signal from the plurality of tension sensors is supplied as a control signal is provided, by which slack of the web is removed and a predetermined preliminary tension is given to the web successively from the upstream side of a web running path by driving each drag roller with torque control based on the control signal from the controller at the start time of printing, and thereafter the driving of the drag roller at a location where the slack of the web has been removed is switched to speed control successively. Therefore, there can be provided the method and the apparatus for controlling web delivery running at the start time of printing, in which the slack of the web (paper) can be removed in a short period of time, the time taken for the tension to be stabilized after the start of printing (after the start of operation) can be shortened greatly, and the occurrence of spoilage caused by inaccurate print registering (deviation of registering) in the web running direction can be reduced significantly.

What is claimed is:

1. A method for controlling web delivery running at the start time of printing, comprising:

providing a printing machine having a plurality of drag rollers disposed one after another in a region from a paper feed side to a paper discharge side of the printing machine;

driving each of the drag rollers one after another starting from the paper feed side with torque control, by which the slack of a web is removed successively starting from an upstream side of a web delivery running path; and after the slack of the web has been removed between the drag rollers, switching control of the drag rollers from torque control to speed control.

2. The method for controlling web delivery running at the start time of printing according to claim 1, further comprising detecting when a tension of the web between the drag rollers becomes nonzero, and, upon detecting said nonzero tension, driving a downstream one of the drag rollers under tension control so as to impart a preliminary tension to the web between the drag rollers.

3. The method for controlling web delivery running at the start time of printing according to claim 1 or 2, wherein a value of tension of the web between a feeder and a feed drag roller and between the drag rollers is detected by a tension sensor, and the tension control of the web is carried out based on the tension value detected by the tension sensor.

4. A method for controlling web delivery running at the start time of printing in a printing machine through which a web is moved in contact with drag rollers located one after another along a web delivery running path from a paper feed side to a paper discharge side of the machine, the method comprising successively performing the steps of:

(a) removing slack of the web successively starting from an upstream side of the web delivery running path by driving the drag rollers one after another starting from the paper feed side;

(b) stopping the driving of each drag roller when the slack of the web on an upstream side of said drag roller is removed in the slack removing step; and (c) switching the driving of each drag roller to speed control after said drag roller is stopped in the stopping step.

5. An apparatus for controlling web delivery running of a web at the start time of printing in a printing machine, comprising:

a feeder, a feed drag roller, and a plurality of drag rollers arranged one after another to define a web delivery running path through the printing machine from a paper feed side to a paper discharge side thereof;

a plurality of tension sensors for detecting a tension of the web between the feeder and the feed drag roller and between the drag rollers; and a controller to which a tension detection signal from each of the plurality of tension sensors is supplied as a control signal, the controller being operable to drive each of the drag rollers in succession to remove slack in the web upstream of said drag roller and to impart a predetermined preliminary tension to the web by driving each drag roller in succession with torque control based on the control signal from the controller at the start time of printing, and thereafter switching the driving of each drag roller at a location where the slack of the web has been removed to speed control successively.

6. A method for controlling movement of a web through a printing device having an infeed side through which web is supplied to the device, a discharge side through which printed web material is discharged, and at least upstream and downstream drag rollers disposed between the infeed and discharge sides and operable for moving the web along a web path through the device, the drag rollers dividing the web path into at least a first segment between the infeed side and the upstream drag roller and a second segment between the upstream drag roller and the downstream drag roller, the method comprising:

holding the downstream drag roller stationary while driving the upstream drag roller to remove slack from the first segment of the web path, and stopping the upstream drag roller upon the slack being removed from the first segment; and subsequently holding the upstream drag roller stationary while driving the downstream drag roller to remove slack from the second segment of the web path.

7. The method of claim 6, further comprising:

following the removal of slack from the first and second segments of the web path, driving all of the drag rollers under speed control.

8. The method of claim 6, wherein the slack is removed from each segment by driving the drag roller located at a downstream end of said segment under torque control until a predetermined torque is achieved.

9. The method of claim 6, further comprising detecting a tension of the web in each segment, and wherein the slack is removed from each segment by driving the drag roller located at a downstream end of said segment under tension control until a predetermined tension is achieved.

* * * * *

UNITED STATES PATENT AND TRADEMARK OFFICE

CERTIFICATE OF CORRECTION

PATENT NO. : 6,176,410 B1
DATED : January 23, 2001
INVENTOR(S) : Ueda et al.

It is certified that error appears in the above-identified patent and that said Letters Patent is hereby corrected as shown below:

Column 2,
Lines 14-18, in the formula:

"

$$F_z \approx \frac{1}{\left(1+\frac{E}{\eta}T_z\right)}\left\{a\cdot 1\cdot E\frac{V_0-V_1}{V_0}+F_1\right\}$$

"

Should read

--

$$F_2 \doteqdot \frac{1}{\left(1+\frac{E}{\eta}T_2\right)}\left\{a\cdot 1\cdot E\frac{V_0-V_1}{V_0}+F_1\right\}$$

--.

Signed and Sealed this

Fifth Day of February, 2002

*Attest:*

*Attesting Officer*

JAMES E. ROGAN
*Director of the United States Patent and Trademark Office*